US010280802B2

(12) United States Patent
Merlau et al.

(10) Patent No.: US 10,280,802 B2
(45) Date of Patent: May 7, 2019

(54) TURBINE CASING JACK

(71) Applicant: GENERAL ELECTRIC COMPANY, Schenectady, NY (US)

(72) Inventors: Thomas Michael Merlau, Greenville, SC (US); Stuart Craig Hanson, Fair Play, SC (US); Brett Darrick Klingler, Piedmont, SC (US); Wayne David Sullivan, Wilmington, SC (US)

(73) Assignee: General Electric Company, Schenectady, NY (US)

( * ) Notice: Subject to any disclaimer, the term of this patent is extended or adjusted under 35 U.S.C. 154(b) by 273 days.

(21) Appl. No.: 15/258,543

(22) Filed: Sep. 7, 2016

(65) Prior Publication Data

US 2018/0066543 A1 Mar. 8, 2018

(51) Int. Cl.

| | |
|---|---|
| ***B66F 3/08*** | (2006.01) |
| ***F01D 25/28*** | (2006.01) |
| ***F01D 5/00*** | (2006.01) |
| ***F01D 25/24*** | (2006.01) |
| ***F01D 25/26*** | (2006.01) |

(52) U.S. Cl.

CPC ..... *F01D 25/285* (2013.01); *B66F 3/08* (2013.01); *F01D 5/005* (2013.01); *F01D 25/24* (2013.01); *F01D 25/243* (2013.01); *F01D 25/265* (2013.01); *F01D 25/28* (2013.01); *F05D 2230/60* (2013.01); *F05D 2230/644* (2013.01); *F05D 2230/68* (2013.01); *F05D 2230/70* (2013.01)

(58) Field of Classification Search

CPC ..... B66F 3/08; F01D 25/28; F01D 25/285; F01D 25/243; F01D 25/265; F01D 25/24; F01D 5/005; F05D 2230/644; F05D 2230/68; F05D 2230/70; F05D 2230/60

See application file for complete search history.

(56) References Cited

U.S. PATENT DOCUMENTS 2,567,335 A * 9/1951 Hebert ..... B60P 1/6409 193/42
3,217,490 A * 11/1965 Chilvers ..... B64C 29/005 244/23 B (Continued)

FOREIGN PATENT DOCUMENTS

EP 2 949 885 A1 12/2015

OTHER PUBLICATIONS

Extended European Search Report and Opinion issued in connection with corresponding EP Application No. 17189511.3 dated Feb. 7, 2018.

*Primary Examiner* — Joseph J Hail
*Assistant Examiner* — Arman Milanian
(74) *Attorney, Agent, or Firm* — Ernest G. Cusick; Hoffman Warnick LLC

(57) ABSTRACT

An apparatus for lifting an inner casing of a turbine includes a base, an arm, a guide roller, and an adjustment system. The arm has a first end and a second end, and is pivotally connected to the base intermediate the first end and the second end. The guide roller is operatively coupled to the first end of the arm to rotatably engage an exterior surface of the inner casing, and an adjustment system extending from the base and engaging the arm to change an angular position of the arm relative to the base and adjust a position of the guide roller relative to the exterior surface of the inner casing.

20 Claims, 5 Drawing Sheets

(56) References Cited

U.S. PATENT DOCUMENTS

| | | | | |
|---|---|---|---|---|
| 4,529,136 | A * | 7/1985 | Gelbar | B02C 15/00 241/121 |
| 5,685,693 | A * | 11/1997 | Sexton | F01D 11/24 415/173.1 |
| 6,224,332 | B1 * | 5/2001 | Leach | F01D 25/243 415/126 |
| 6,532,840 | B2 * | 3/2003 | Hatley | B25J 5/00 356/241.1 |
| 8,127,417 | B1 * | 3/2012 | Butler | B23P 19/025 29/255 |
| 8,844,107 | B2 * | 9/2014 | Casavant | B23P 11/00 29/240 |
| 9,269,463 | B2 * | 2/2016 | Villagomez | G21C 17/007 |
| 10,040,579 | B1 * | 8/2018 | Henderson | B65D 85/68 |
| 2006/0101643 | A1 | 5/2006 | Adinarayana et al. | |
| 2009/0183349 | A1 * | 7/2009 | Walsh | B23P 15/006 29/23.51 |
| 2010/0083499 | A1 * | 4/2010 | Shigemoto | F01D 25/26 29/889.1 |
| 2011/0185570 | A1 * | 8/2011 | Bird | B23P 6/002 29/888.021 |
| 2012/0282089 | A1 | 11/2012 | Predmore et al. | |
| 2013/0326875 | A1 * | 12/2013 | Black | F01D 25/285 29/888.01 |
| 2014/0026414 | A1 * | 1/2014 | Holmes | F01D 9/04 29/888.021 |
| 2014/0130342 | A1 | 5/2014 | Casavant et al. | |
| 2015/0336222 | A1 * | 11/2015 | Aratori | F01D 25/285 414/589 |
| 2015/0361894 | A1 * | 12/2015 | Murphy | F02C 7/20 29/888.012 |

* cited by examiner

TURBINE CASING JACK

FIELD OF THE INVENTION

The subject matter disclosed herein relates to a jacking tool. More specifically, the subject matter disclosed herein relates to a roller jack for rotatably support, lifting, and aligning an inner turbine casing relative to a turbine rotor.

BACKGROUND OF THE INVENTION

A typical gas turbine includes a turbine section having alternating stages of fixed nozzles and rotating buckets, and a turbine casing assembly generally surrounding the turbine section. The turbine casing assembly includes an inner casing and an outer casing. Gas turbines are typically designed with a split in the inner and outer casings along a horizontal centerline of the unit, to enable the inner and outer casings to be separated into upper and lower halves. When a maintenance operation needs to be performed on a gas turbine, it is often necessary that one or more sections of the inner and outer casings be removed. For example, it is common to remove sections of the inner and outer casings to allow maintenance workers to inspect and/or replace nozzles/buckets and/or to perform various other scheduled maintenance operations. Reassembly of the inner and outer casings requires realigning the inner casing with an axis of a turbine rotor.

In the disassembly and/or reassembly of gas turbine casings, roller jacks may be employed to move sections of the casings. For example, a lower half of an inner casing may be supported on roller jacks after removal of the upper half of the inner and outer casings, for access to the interior of the gas turbine. The interior of the gas turbine can further be accessed by rolling the lower half of the inner casing on the roller jacks to rotate the inner casing upward to a position where its removal is not obstructed by internal components of the gas turbine. Further, when reassembling the casings, the casings must be repositioned and aligned to an appropriate or desirable position (e.g., centered around a turbine rotor). Roller jacks can support the inner casing and be adjusted to position the inner casing with respect to the outer casing and internal turbine components (e.g., a rotor).

Because typical inner and outer casing assemblies are very heavy, the roller jacks that are employed are usually hydraulic jacks, which can handle very large loads. However, fine tuning the positioning of a hydraulic jack can be difficult, which may lead to improper alignment and/or damage of tight assembly clearance parts of gas turbines with which they are used. For example, overshoot during extension of a hydraulic jack may cause a collision of the casing into a turbine blade tip. In addition, hydraulic jacks have a tendency to retract under load if left extended for a period of time so that repositioning may become necessary if a user leaves the jack to adjust another portion of the casing assembly. Furthermore, conventional roller jacks, while lighter and smaller than some alternative equipment used to dissemble/reassemble a turbine casing assembly, are still quite heavy for a person to lift and manipulate, and overly bulky for the tight working spaces in and around a turbine.

BRIEF DESCRIPTION OF THE INVENTION

A first aspect of the disclosure includes a roller jack for rotatably supporting an inner casing of a turbine. The roller jack includes a base, an arm, a guide roller, and an adjustment system. The base includes a mounting element configured to couple to an outer casing of the turbine. The arm is pivotally connected to the base, and the arm has a first end and a second end. The guide roller is rotatably positioned at the first end of the arm and configured to rotatably engage an exterior surface of the inner casing of the turbine. The adjustment system is configured to adjustably pivot the arm relative to the base to engage the guide roller with the exterior surface of the inner casing.

A second aspect of the disclosure includes a roller jack for lifting an inner casing of a turbine. The roller jack includes a base, an arm, a guide roller, and an adjustment element. The arm has a first end and a second end, and is pivotally connected to the base intermediate the first end and the second end. The guide roller is operatively coupled to the first end of the arm to rotatably engage an exterior surface of the inner casing. The adjustment system extends from the base and engages the arm to change an angular position of the arm relative to the base and engage the guide roller to rotatably engage the exterior surface of the inner casing.

BRIEF DESCRIPTION OF THE DRAWINGS

These and other features of this invention will be more readily understood from the following detailed description of the various aspects of the invention taken in conjunction with the accompanying drawings that depict various embodiments of the disclosure, in which.

Figure 1:
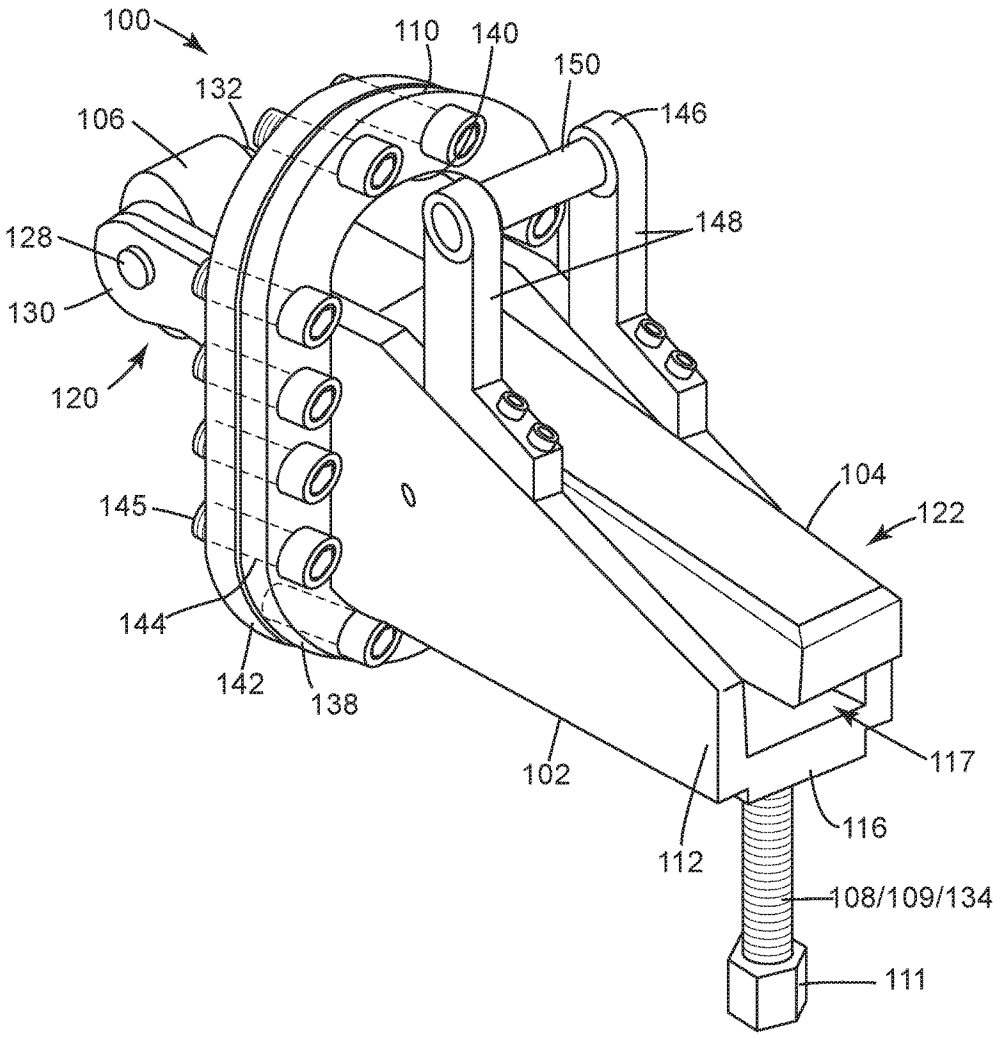
FIG. 1 is a perspective view illustrating a roller jack for rotatably supporting and aligning an inner casing of a turbine relative to a rotor of the turbine, according to various embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As noted, the subject matter disclosed herein relates to a roller jack for rotatably supporting, lifting, and aligning a turbine inner casing relative to a turbine rotor. In contrast to conventional roller jacks, embodiments of the roller jack disclosed herein are simpler to operate, smaller, and lighter, all of which facilitates their relative ease of use in tight working spaces.

Figure 2:
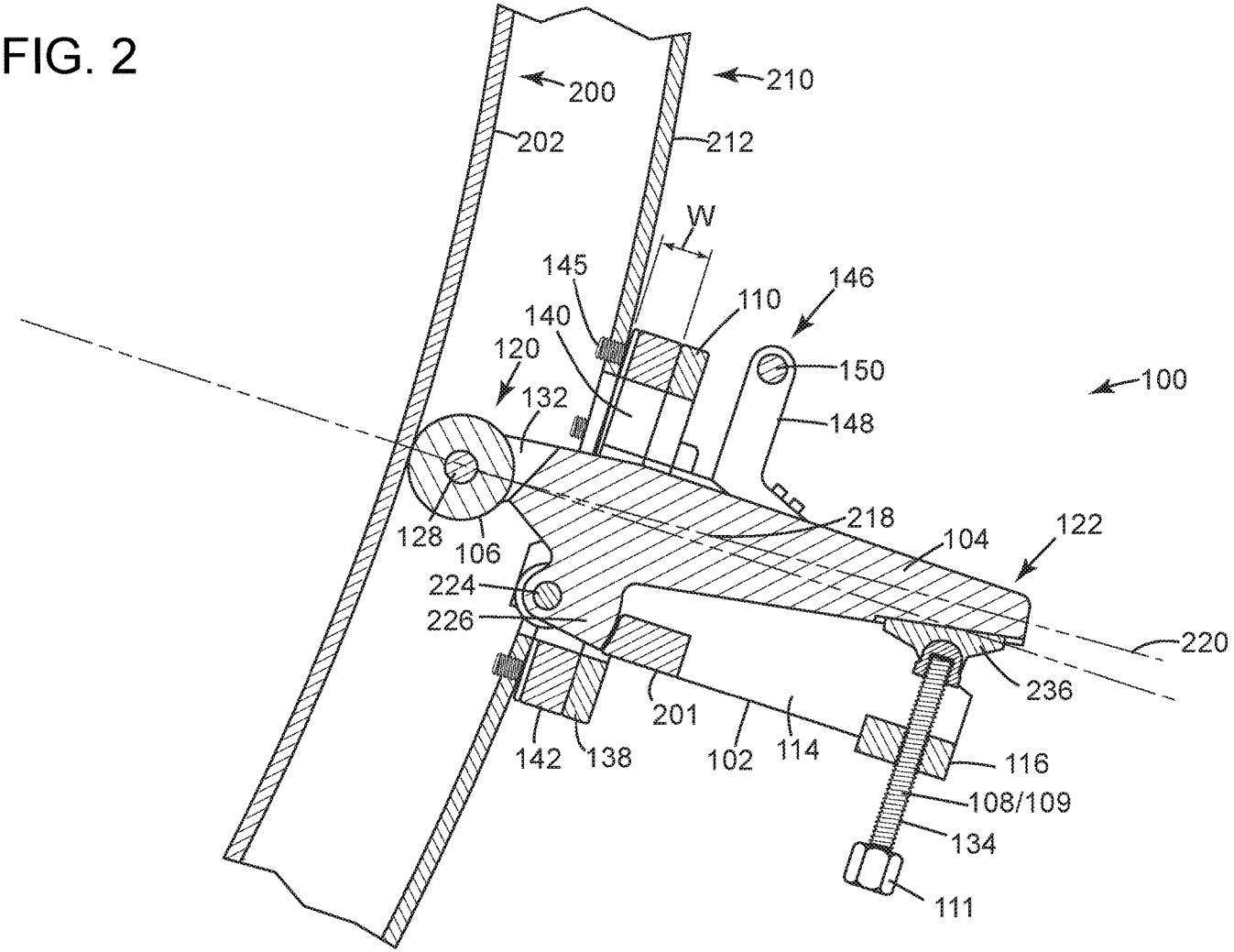
FIG. 2 is a cross-sectional, side view of the roller jack shown in FIG. 1.

FIG. 1 is a perspective view illustrating a roller jack 100 for rotatably supporting, lifting, and/or aligning, for example, an inner casing 200 (FIG. 2) of a turbine relative to a rotor of the turbine (not shown), according to various embodiments. FIG. 2 is a cross-sectional, side view of roller jack 100 in use with an inner casing 200 and an outer casing 210 of a turbine. Referring to FIG. 1 and FIG. 2, roller jack 100 can include a base 102, an arm 104, a guide roller 106, and an adjustment system 108.

Base 102 can be a rigid body to provide support and structure for roller jack 100. Base 102 can take on a variety of shapes which provide for support and connection of other roller jack components. In the embodiment depicted by FIG. 1 and FIG. 2, base 102 has a first wall 112, a second wall 114 parallel to first wall 112, and a connecting member 116 connecting first wall 112 and second wall 114. First wall 112 and second wall 114 define a slot 117 in which arm 104 can fit.

A stop element 201 can be connected to or integrated with base 102. Stop element 102 is configured to limit pivotal motion of arm 104 relative to base 102. Stop element 201 is positioned or located in slot 117 adjacent base 102.

A handle 146 can be connected to or integrated with base 102. Handle 146 can include at least one support element 148 connected to or extending from base 102, and a gripping element 150 connected to at least one support element 148. Two support elements 148 are depicted in FIG. 1, but one is conceived, as are three or more. Roller jack 100, while smaller and lighter than conventional jacks, might still be considered heavy for a person to lift and move. Handle 146 can facilitate easier lifting and moving of roller jack 100.

A mounting element 110 can be connected to, or integrated with, base 102. Mounting element 110 can include a flange 138 at least partly surrounding a portion of arm 104. In some cases, flange 138 can define a central opening 140 through which arm 104 can extend. While flange 138 is shown as including an oblong hole, flange 138 can have any shape to accommodate fastening to outer casing 210 and appropriate passage/positioning of arm 104 and guide roller 106. Flange 138 can also have a plurality of apertures 144. Each aperture 144 can be configured to receive a fastener 145 for mounting or coupling roller jack 100 to an exterior surface 212 of outer casing 210 of the turbine.

Figure 3:
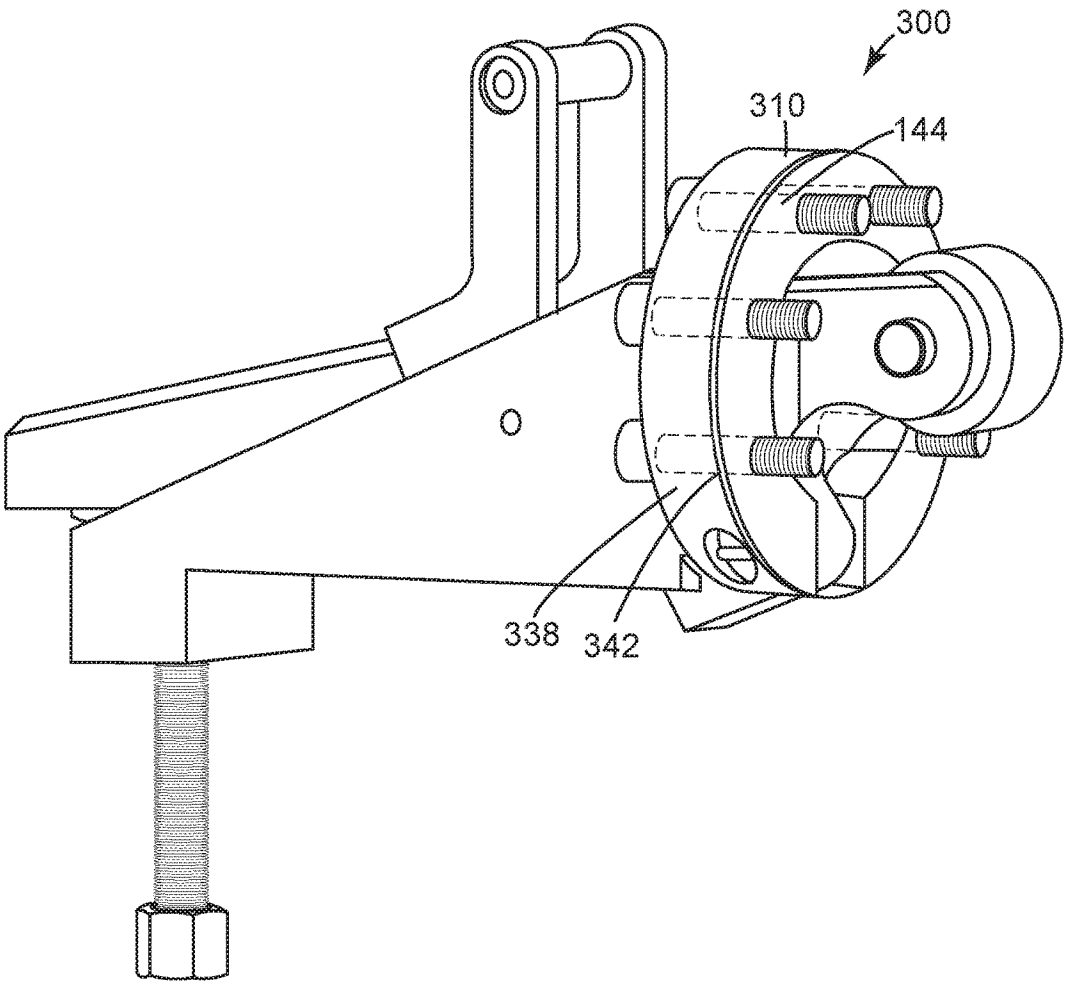
FIG. 3 is a perspective view illustrating a roller jack according to various embodiments.

FIG. 3 illustrates a roller jack 300 having a mounting element 310 that includes a flange 338. Flange 338 is smaller than flange 138, with fewer apertures 144, for mounting roller jack 300 in a smaller, more confined space, or on a smaller area of exterior surface 212 of outer casing 210.

Figure 4:
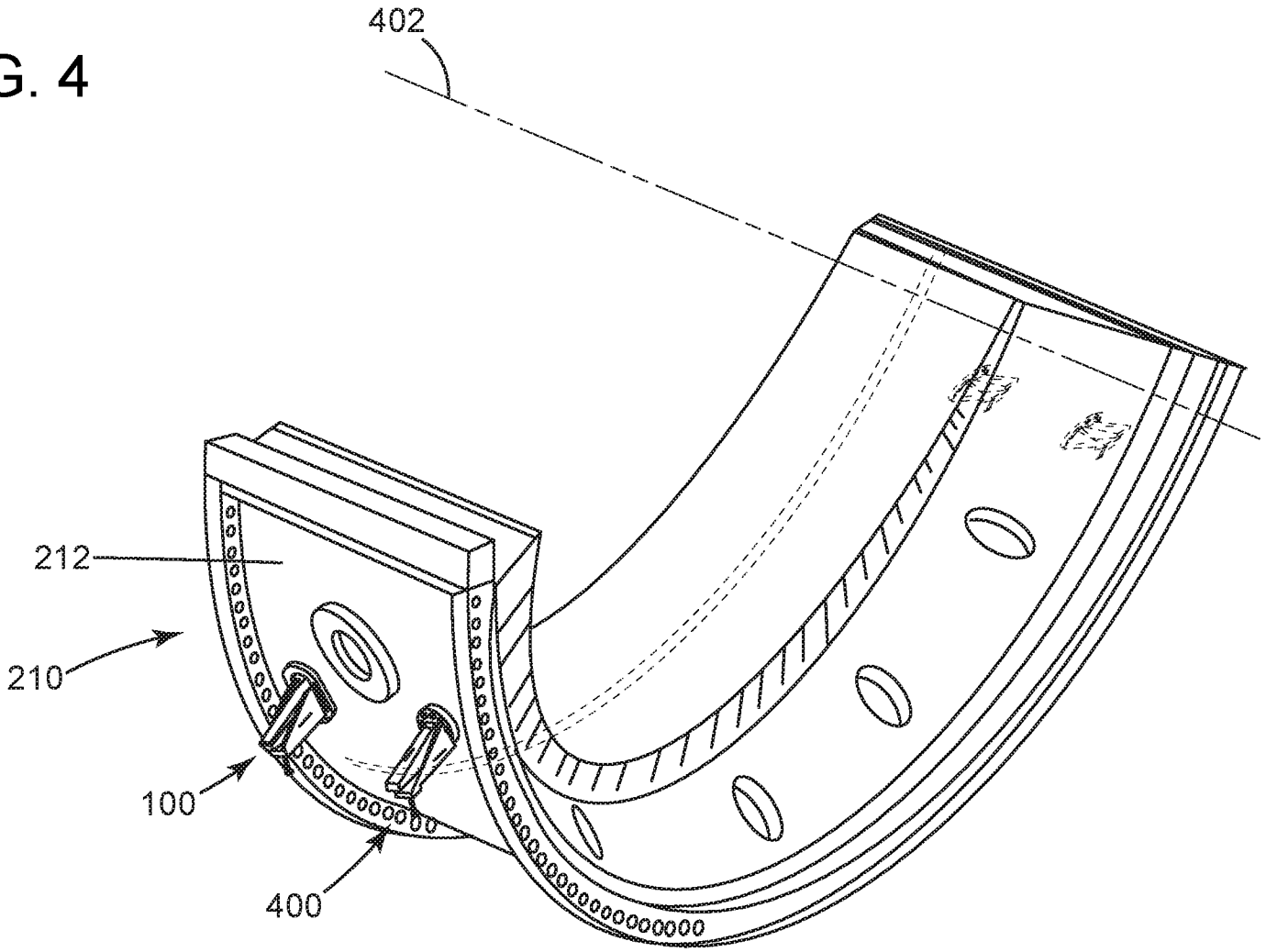
FIG. 4 is a perspective view of multiple roller jacks coupled with, or mounted to, an outer casing of a turbine, according to various embodiments.

FIG. 4 illustrates multiple roller jacks 100, 300 coupled or mounted to exterior surface 212 of outer casing 210 of a turbine. As depicted in FIG. 4, in some embodiments, roller jack 100 is mounted at a forward location on outer casing 210, while roller jack 300 is mounted at an aft location on outer casing 210. In these cases, the forward location has more space to fit the larger mounting element 110 of roller jack 100, while the aft location has less space and requires a smaller mounting element such as mounting element 310 of roller jack 300.

Referring again to FIG. 1 and FIG. 2, mounting element 110 can further include a shim 142 approximately matching the shape of flange 138 and configured to mate with flange 138. Shim 142 can be fashioned with various widths W in order to adapt roller jack 100 for use with varying models or sizes of turbines and turbine casings, to adjust how far arm 104 and guide roller 106 need to extend beyond outer casing 210 to engage inner casing 200. Different turbines might require roller jack 100 to extend through outer casing 400 to different lengths in order to engage inner casing 200 as desired. Referring to FIG. 3, roller jack 300 can also have a shim 342 approximately matching the shape of flange 338 and configured to mate with flange 338.

As shown in FIG. 2, arm 104 includes a longitudinal section 218 extending from a first end 120 to a second end 122. Arm 108 can be pivotally connected to base 102, such that arm 104 can swing or pivot relative to base 102, and change an angular position of arm 104 relative to base 102. The pivotal connection can be facilitated by a pivot pin 124 connecting arm 104 to base 102. Pivot pin 224 can be fixedly connected (or directly connected) or rotationally connected to either base 102 or arm 104, such that arm 104 can pivot around an axis of pivot pin 124 relative to base 102. Pivot pin 124 can extend through arm 104 and at least part of base 102. The pivotal connection of pivot pin 124 can be between first end 120 and second end 122. The pivotal connection can also be offset from a direct line or path between first end 120 and second end 122. In other words, arm 104 can have a longitudinal axis 220 extending from first end 120 to second end 122, and the pivot connection section 226 can be offset from longitudinal axis 220 where pivot pin 124 can connect to arm 104. Pivot connection section 226 can protrude from longitudinal section 218 between first end 120 and second end 122. The protruding shape of pivot connection section 226 can create a concavity in which stop element 201 can be located adjacent and between pivot connection section 226 and longitudinal section 218, where it can limit motion of arm 104 in both clockwise and counter-clockwise directions.

Guide roller 106 is operatively positioned on first end 120 of arm 104. Guide roller 106 can be any currently known or later developed part or device capable of rotatingly engaging and supporting an exterior surface 202 of inner casing 200. In the embodiment depicted in FIG. 1 and FIG. 2, guide roller 106 rotates around a roller pin 128. First end 120 of arm 104 includes a first finger 130 spaced from a second finger 132, and roller pin 128 spans the space, connecting from first finger 130 to second finger 132. Guide roller 106 is positioned to rotate or roll on roller pin 128 in this space between first finger 130 and second finger 232. Guide roller 106 is located such that guide roller 106 can contact exterior surface 202 of inner casing 200 of a turbine when roller jack 100 is in use mounted to exterior surface 212 of outer casing 210 of the turbine and rotatably support inner casing 200 (FIG. 2) relative to arm 104. Because turbine casings are very heavy, guide roller 106 can be made of hardened material such as steel.

As seen in FIG. 2, adjustment system 108 is configured to adjustably pivot arm 104 and guide roller 106 relative to base 102, e.g., such that guide roller 106 can be brought into and out of rotating engagement and support of inner casing 200. To adjustably pivot arm 104, adjustment system 108 can be engaged with, attached to, or connected to base 102, and adjustment system 108 can include an adjustment member 109 extending from base 102 toward arm 104, and being length-adjustable to change a position of arm 104 relative to base 102. A contact head 236 can be pivotally attached to adjustment member 109, configured to engage, couple with, or contact arm 104, or to be engaged with, attached to, couple with, or connected to arm 104. Contact head 236 can have a larger diameter or larger contact surface area (i.e., surface area configured to contact arm 104) than adjustment member 109 would have without contact head 236.

Adjustment system 108 can be located proximate second end 122 of arm 104. "Proximate" second end 122 of arm 104 can mean any location toward second end 122 from pivot pin 124 or pivot connection section 126, such that adjustment system 108 can engage arm 104 on an opposing side of arm 104 relative to guide roller 106. The farther toward second end 122 from pivot pin 124 or pivot connection section 126 adjustment system 108 is located, the more leverage adjustment system 108 has to move arm 104 and guide roller 106.

As depicted in FIG. 1 and FIG. 2, adjustment member 109 can be a threaded shaft 134 threadably engaged or engageable with base 102, and which can extend from base 102 toward arm 104. Threaded shaft 134 can be rotated relative to base 102 and arm 104, to push second end 122 of arm 104 away from base 102 and/or pull second end 122 of arm 104 toward base 102.

Figure 6:
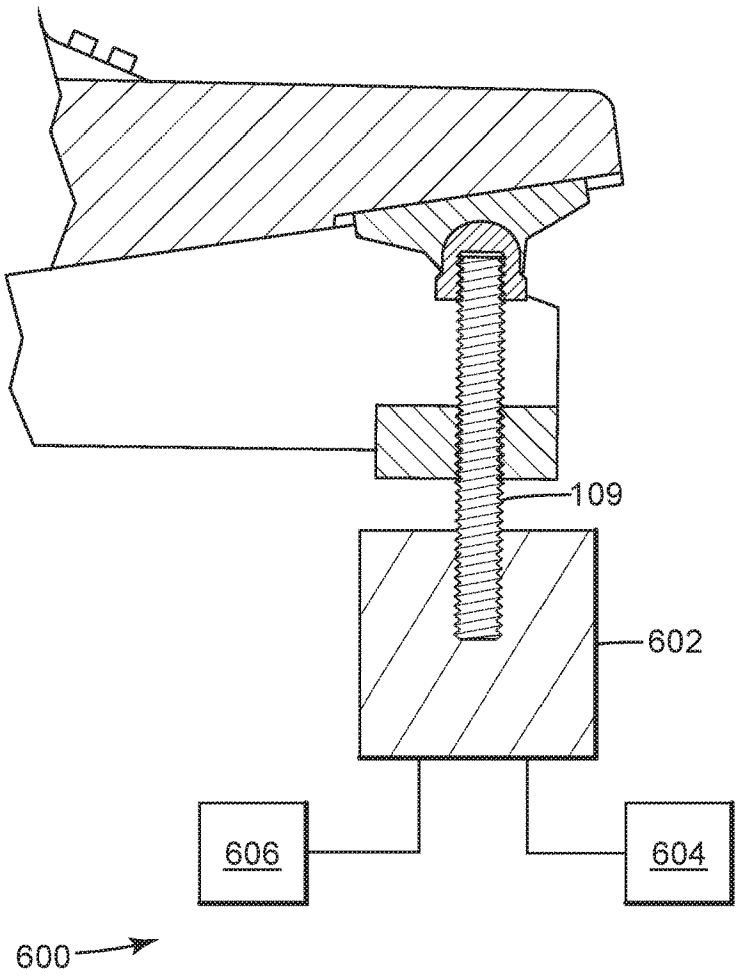
FIG. 6 is a cross-sectional, side view of a roller jack, according to various embodiments.
Figure 5:
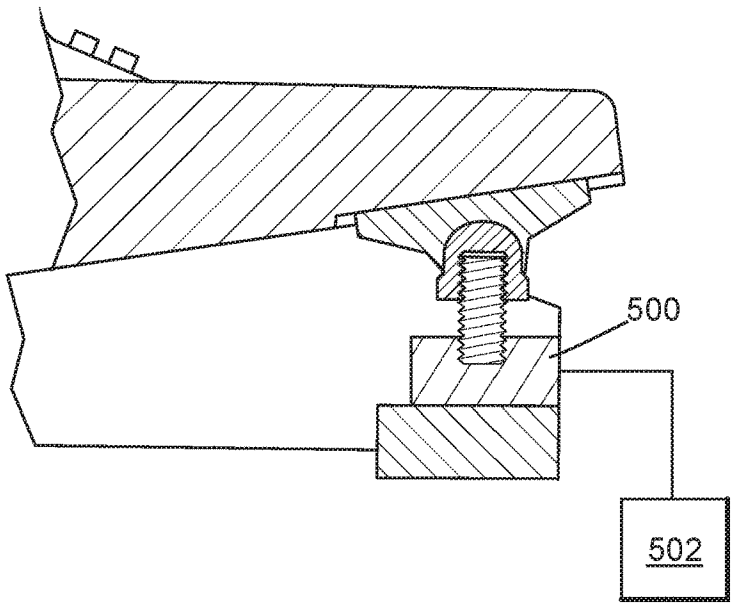
FIG. 5 is a cross-sectional, side view of a roller jack, according to various embodiments.

Alternatively to adjustment member 109 having threaded shaft 134, adjustment system 108 can include other devices operable to push second end 122 of arm 104 away from base 102 and/or pull second end 122 of arm 104 toward base 102. A hydraulic pancake cylinder 500 coupled with a fluid source 502, as depicted in FIG. 5, is an example of another device that can operate to facilitate pivoting of arm 104. Further, adjustment member 109 can be manually-operated or power-driven by a drive system. For example, in the embodiment depicted in FIG. 2, a manually-operated adjustment member 109 can have a manual adjustment interface 111 by which a human operator can more easily turn a threaded adjustment member 109. Adjustment member 109 with threaded shaft 134 can instead be turned by a drive system 600, including a motorized actuator 602 coupled with an internal or external power source 604, as depicted in FIG. 6. Further, a power-driven embodiment, such as one including motorized actuator 602 in FIG. 6 can be computerized, so that a control system 606 can be configured to control adjustment, with input from a human operator. The embodiment including a manually-operated threaded shaft 134 requires relatively little space and is relatively light in weight, as compared to conventionally used jacks. Ideally, the motorized actuator 602 and the hydraulic pancake cylinder 500 weigh less than conventionally used hydraulic equipment, and utilize less space as well.

Adjustment of adjustment member 109 includes adjusting a length of adjustment member 109 between base 102 and arm 104, to either move second end 122 of arm 104 from base 102 and pivot first end 120 of arm 104 toward base 102 or move second end 122 of arm 104 toward base and pivot first end 130 of arm away from base 102. To move second end 122 of arm 104 from base 102, adjustment member 109 can be adjusted to lengthen the distance of adjustment member 109 between arm 104 and base 102. To move second end 122 of arm 104 toward base 102, adjustment member 109 can be adjusted to shorten the distance of adjustment member 109 between arm 104 and base 102, and weight or force on first end 120, such as the weight of inner casing 200, can be relied upon to press first end 120 of arm 104 away from base 104 and pivot second end 122 of arm 104 toward adjustment system 108 and base 102. Alternatively, adjustment system 108 can be connected to arm 104 such that adjustment of adjustment member 109 draws second end 122 of arm 104 toward base 102 and pivots first end 120 of arm 104 away from base 102.

During adjustment of adjustment member 109 and/or support of inner casing 200, the larger diameter or contact surface area of contact head 236 disperses force on the surface of arm 104 over a larger area, reducing or preventing damage to inner casing 200. The pivotal connection of contact head 236 on adjustment member 109 facilitates mating contact between contact head 236 and arm 104 during adjustment of adjustment system 108, as adjustment member 109 moves linearly and the angle between arm 104 and adjustment member 109 changes.

Referring to FIG. 4, typically, a set of four roller jacks (e.g., two forward roller jacks 100 and two aft roller jacks 300) are positioned symmetrically around the outer casing 210 to provide stable support of inner casing 200. One roller jack 100, 300 can be adjusted manually at a time, multiple people can manually adjust two or more roller jacks 100, 300 simultaneously, or the set of roller jacks 100, 300 can be power-driven and adjusted singly or simultaneously. When a guide roller 106 rotatably supports inner casing 200, the pivoting of a single arm 104 and a guide roller 106 relative to base 104 moves inner casing 200 at a point of contact with guide roller 106 relative to an axis of the rotor (not shown). The casing 200 at the point of contact can be moved up or down, or laterally, depending on the direction of adjustment of adjustment system 108, the angle of orientation of longitudinal section 218 relative to inner casing 200, and the location around a circumference of inner casing 200 that guide roller 106 engages exterior surface 202 of inner casing 200. The angle of orientation and location around the circumference of inner casing 200 can be set or adjusted as desired. Adjusting one roller jack 100, 300 changes the angle of a center axis 402 of inner casing, while adjusting two roller jacks (e.g., one forward jack 100 and one aft jack 300) on a same side of inner casing 200 an equal amount maintains the angle of center axis 402 and pivots inner casing 200 upward or downward relative to the center axis of the rotor. Adjusting all four roller jacks 100, 300 an equal amount lifts or lowers inner casing 200 while maintaining existing lateral alignment and angle of center axis 402.

Adjustment member 109, arm 104, guide roller 106, and the pivotal connection between arm 104 and base 102, can be configured such that adjustment member 109 can be adjusted in length a predetermined amount to achieve a predetermined movement of guide roller 106, which knowing the positional relationships between inner casing 200 and outer casing 210, and the mounting location of roller jack 100 on outer casing 210, can translate to a known or predetermined movement of inner casing 200. For example, roller jack 100 can be configured such that 0.254 millimeters (approximately 0.01 inches) of axial movement of adjustment member 109, when inner casing 200 is directly supported on guide roller 106, can vertically lift inner casing 200 at the point of contact between guide roller 106 and inner casing 200 0.254 millimeters (approximately 0.01 inches). Such a configuration facilitates relative ease of manual operation in positioning and aligning inner casing 200 relative to the turbine rotor (not shown). Further, adjustment system 108 has a relatively small footprint, further facilitating the ability of roller jack 100 to be used in small working spaces.

A method of rotating and positioning an inner casing of a turbine relative to a rotor of the turbine is described with reference, but is not intended to be limited, to the apparatuses and components shown in FIGS. 1-4. The method can include coupling at least one jack 100, 300 to exterior surface 212 of outer casing 210 of a turbine, and adjusting adjustment system 108 to pivot arm 104 relative to base 102, to rotatably support inner casing 202 of the turbine, and to move a center axis of inner casing 202. In operation, the method can include rotating adjustment member 109 to move adjustment member 109 toward or away from arm 104. In some cases, the method can include actuating a drive system 600 to adjust adjustment system 108. In some cases, the drive system can be electrically-powered, computerized, and/or automated to rotate adjustment member 109.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A roller jack for rotatably supporting an inner casing of a turbine, the roller jack comprising:

a base including a mounting element configured to couple to an outer casing of the turbine;

an arm pivotally connected to the base, the arm having a first end and a second end;

a pivot pin extending through the arm and through at least a portion of the base, the pivot pin pivotally connecting the arm to the base;

a guide roller rotatably positioned at the first end of the arm, the guide roller configured to rotatably engage an exterior surface of the inner casing of the turbine; and an adjustment system configured to adjustably pivot the arm relative to the base to adjust a position of the guide roller relative to the exterior surface of the inner casing.

2. The roller jack of claim 1, wherein the mounting element includes a flange, the flange surrounding at least a portion of the arm.

3. The roller jack of claim 2, wherein the mounting element further comprises a shim approximately matching the shape of the flange and configured to mate with the flange.

4. The roller jack of claim 2, wherein the flange includes a plurality of apertures, each aperture configured to receive a fastener for mounting the base to the outer casing of the turbine.

5. The roller jack of claim 1, wherein the arm has a longitudinal axis and a pivot connection section, the longitudinal axis extending from the first end to the second end of the arm, the pivot connection section being offset from the longitudinal axis between the first end and the second end of the arm, the pivot pin connecting to the arm at the pivot connection section.

6. The roller jack of claim 1, wherein the base comprises a mechanical stop configured to limit pivotal motion of the arm relative to the base.

7. The roller jack of claim 1, wherein the adjustment system includes a threaded member threadably engaging the base and engaging the second end of the arm, wherein adjustment of the threaded member adjusts a position of the guide roller and the arm relative to the base.

8. The roller jack of claim 7, wherein the threaded member engages with the arm proximate the second end of the arm.

9. The roller jack of claim 1, further comprising a handle coupled to the base.

10. An apparatus for lifting an inner casing of a turbine, the apparatus comprising:

a base;

an arm having a first end and a second end, the arm pivotally connected to the base intermediate the first end and the second end;

a guide roller operatively coupled to the first end of the arm to rotatably engage an exterior surface of the inner casing; and an adjustment system extending from the base and engaging the arm to change an angular position of the arm relative to the base and adjust a position of the guide roller relative to the exterior surface of the inner casing.

11. The apparatus of claim 10, wherein the adjustment system couples to the arm proximate the second end of the arm and is configured to adjust a position of the arm.

12. The apparatus of claim 11, wherein the arm has a longitudinal axis and a pivot connection section, the longitudinal axis extending from the first end to the second end of the arm, the pivot connection section being offset from the longitudinal axis between the first end and the second end of the arm, the pivotal connection of the arm to the base being at the pivot connection section.

13. The apparatus of claim 10, wherein the base comprises a mounting element configured to mount to an exterior surface of an outer casing of the turbine.

14. The apparatus of claim 10, wherein the guide roller comprises a hardened roller bearing.

15. The apparatus of claim 10, wherein the base comprises a mechanical stop configured to limit pivotal motion of the arm relative to the base.

16. A roller jack for rotatably supporting an inner casing of a turbine, the roller jack comprising:

a base including a mounting element configured to couple to an outer casing of the turbine;

an arm pivotally connected to the base, the arm having a first end and a second end;

a mechanical stop connected to the base, the mechanical stop configured to limit pivotal motion of the arm relative to the base;

a guide roller rotatably positioned at the first end of the arm, the guide roller configured to rotatably engage an exterior surface of the inner casing of the turbine; and an adjustment system configured to adjustably pivot the arm relative to the base to adjust a position of the guide roller relative to the exterior surface of the inner casing.

17. The roller jack of claim 16, wherein the adjustment system includes an adjustable member engaging the base and engaging the arm, wherein adjustment of the adjustable member adjusts a position of the guide roller and the arm relative to the base.

18. The roller jack of claim 17, wherein the adjustable member engages with the arm proximate the second end of the arm.

19. The roller jack of claim 16, further comprising a handle coupled to the base.

20. The roller jack of claim 16, wherein the mounting element of the base further includes:

a flange surrounding at least a portion of the arm; and a shim approximately matching the shape of the flange and configured to mate with the flange.

* * * * *